US006171741B1

(12) United States Patent
Evans et al.

(10) Patent No.: US 6,171,741 B1
(45) Date of Patent: Jan. 9, 2001

(54) LIGHT SHOCK RESISTANT ELECTROPHOTOGRAPHIC IMAGING MEMBER

(75) Inventors: Kent J. Evans, Lima; Kathleen M. Carmichael, Williamson; James B. O'Leary, Rochester; Damodar M. Pai, Fairport; Donald P. Sullivan, Rochester; Markus R. Silvestri, Fairport; James C. Lamy, Rochester, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/487,574

(22) Filed: Jan. 19, 2000

(51) Int. Cl.[7] ..... G03G 5/047

(52) U.S. Cl. ..... 430/58.35; 430/58.5; 430/58.65; 430/59.4; 430/132

(58) Field of Search ..... 430/58.35, 58.5, 430/58.65, 59.4, 132

(56) References Cited

U.S. PATENT DOCUMENTS

| | | | |
|---|---|---|---|
| 4,233,384 | 11/1980 | Turner et al. | 430/72 |
| 4,265,990 | 5/1981 | Stolka et al. | 430/96 |
| 4,286,033 | 8/1981 | Neyhart et al. | 430/60 |
| 4,291,110 | 9/1981 | Lee | 430/60 |
| 4,299,897 | 11/1981 | Stolka et al. | 430/73 |
| 4,306,008 | 12/1981 | Pai et al. | 430/85 |
| 4,338,387 | 7/1982 | Hewitt | 430/85 |
| 4,439,507 | 3/1984 | Pan et al. | 430/66 |
| 4,599,286 | 7/1986 | Limburg et al. | 430/58.65 |
| 4,650,737 * | 3/1987 | Wiedemann | 430/58.5 |
| 4,654,284 | 3/1987 | Yu et al. | 430/531 |
| 5,164,276 | 11/1992 | Robinson et al. | 430/58.2 |
| 5,344,733 * | 9/1994 | Suzuki et al. | 430/58.5 |
| 5,384,223 | 1/1995 | Listigovers et al. | 430/96 |
| 5,492,785 | 2/1996 | Normandin et al. | 430/63 |
| 5,521,306 | 5/1996 | Burt et al. | 540/141 |

FOREIGN PATENT DOCUMENTS

| | | | |
|---|---|---|---|
| 63-280256 * | 11/1983 | (JP) | 430/58.5 |

* cited by examiner

*Primary Examiner*—Roland Martin
(74) *Attorney, Agent, or Firm*—Oliff & Berridge, PLC; Eugene O. Palazzo

(57) ABSTRACT

An electrophotographic imaging member is improved in light shock resistance by including in the charge transport layer a light shock resisting additive of triethanolamine, morpholine, an imidazole or mixtures thereof. The imaging member preferably has a charge generating layer containing hydroxygallium phthalocyanine, alkoxygallium phthalocyanine and mixtures thereof as the photogenerating particles. The method of rendering an imaging member including such a charge generating layer acceptably resistant to light shock includes forming a charge transport layer in association with the charge generating layer to contain the light shock resisting additive of triethanolamine, morpholine, an imidazole or mixtures thereof.

17 Claims, 2 Drawing Sheets

LIGHT SHOCK RESISTANT ELECTROPHOTOGRAPHIC IMAGING MEMBER

BACKGROUND OF THE INVENTION

1. Field of the Invention

This invention relates in general to electrophotographic imaging members. More specifically, the invention relates to an electrophotographic imaging member having improved resistance to light shock and a method of using the imaging member.

2. Discussion of Related Art

In the art of electrophotography, an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable electrophotographic imaging members.

The electrophotographic imaging members may be in the form of plates, drums or flexible belts. These electrophotographic members are usually multilayered photoreceptors that comprise a substrate, a conductive layer, an optional hole blocking layer, an optional adhesive layer, a charge generating layer, a charge transport layer, an optional overcoating layer and, in some belt embodiments, an anticurl backing layer.

Photoreceptors are susceptible to varying degrees of light shock, depending on the type of charge generating layer used in the photoreceptor. Light shock is a phenomenon in which a photoreceptor exposed to room light exhibits an increase in dark decay and depletion when subsequently utilized in an electrophotographic imaging process conducted by an electrophotographic imaging device such as a printer, copier or duplicator. Such exposure to light may occur, for example, during installation of the photoreceptor or during servicing of the device. It is believed that light shock can be defined/quantified in terms of exposure time, dark rest time, and $V_{ddp}$ voltage differential (exposed area versus unexposed area).

Due to light shock, areas of the photoreceptor that are rendered electrically conductive by exposure to room light remain conductive after termination of the exposure event. For photoreceptors susceptible to light shock, particularly for very large photoreceptor belts such as a 10 pitch belts, exposure to light results in different degrees of light exposure for different regions of the photoreceptor, e.g., the top, sides and bottom of the photoreceptor belt experience different degrees of light shock. Thus, for example during belt replacement or machine maintenance, non-uniform exposure of the photoreceptor to room light leads to non-uniformity in $V_{ddp}$ (dark development potential).

$V_{ddp}$ refers to the potential attained at the development station without the photoreceptor being exposed to light. Typical values of $V_{ddp}$ may be between about 600 and about 1000 volts in a given machine. $V_{ddp}$ registers two types of changes with cycling. In the first change, after initial exposure, the dark decay undergoes changes in a few cycles and thereafter becomes stable at a crest value. The second is a long term effect which manifests itself as a gradual decrease in $V_{ddp}$ (increase in dark decay) over many tens of kilocycles.

A 5 $V_{ddp}$ voltage differential between exposed areas and unexposed areas of a photoreceptor is undesirable because it leads to non-uniform image potentials which, in turn, leads to the formation of non-uniform toner images when the light shocked photoreceptor is subsequently utilized for electrophotographic imaging.

The light shock problem is particularly serious in photoreceptors containing hydroxygallium phthalocyanine or alkoxygallium phthalocyanine particles as photogenerating pigments, for example dispersed in a polymer binder in the charge generating layer. For very high quality imaging, this non-uniformity is extremely undesirable.

The dramatic variation in conductivity due to light shock cannot be compensated with automatic controls even in highly complex and sophisticated machines. It is therefore desired to develop a photoreceptor resistant to light shock.

U.S. Pat. No. 5,164,276 describes charge generating layers and charge transport layers for electrophotographic imaging members in which the charge generation layer or charge transport layer includes a dopant of organic molecules containing basic electron donor or proton acceptor groups. Preferred dopants include aliphatic and aromatic amines, more preferably, triethanolamine, n-dodecylamine, n-hexadecylamine, tetramethyl guanidine, 3-aminopropyltriethoxy silane, 3-aminopropyltrihydroxysilane and its oligomers. Doping of the charge generating layer is preferred (column 4, line 67 to column 5, line 3). The dopants are not identified to provide light shock resistance, and hydroxygallium phthalocyanine is not identified as a photogenerating particle to be included in the charge generating layer.

U.S. Pat. No. 5,521,306 describes a process for preparation of Type V hydroxygallium phthalocyanine comprising the in situ formation of an alkoxy-bridged gallium phthalocyanine dimer, hydrolyzing the dimer to hydroxygallium phthalocyanine and subsequently converting the hydroxygallium phthalocyanine product obtained to Type V hydroxygallium phthalocyanine.

U.S. Pat. No. 5,492,785 describes an electrophotographic imaging member having an imaging surface adapted to accept a negative electrical charge, the electrophotographic imaging member comprising a metal ground plane layer comprising at least 50 percent by weight zicronium, a siloxane hole blocking layer, an adhesive layer comprising a polyacrylate film forming resin, a charge generation layer comprising benzimidazole perylene particles dispersed in a film forming resin binder of poly(4,4'-diphenyl-1,1'-cyclohexane carbonate), and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,599,286 describes an electrophotographic imaging member comprising a charge generation layer an a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 4,265,990 describes a photosensitive member having at least two electrically operative layers. The first layer comprises a photoconductive layer and the second layer comprises a charge transport layer. The charge transport layer comprises a polycarbonate resin and a diamine having a certain specified structure. Also, metal phthalocyanines are disclosed as useful as charge generators. A photoconductor particle size of about 0.01 to 5.0 micrometers is mentioned.

As described above, there is a continuing need for versatile high quality photoreceptors that are resistant to light shock.

SUMMARY OF THE INVENTION

It is an object of the present invention to provide an improved photoreceptor which overcomes the above-noted deficiencies. It is yet another object of the present invention to provide an improved photoreceptor having high quality photoconductive coatings. It is still another object of the present invention to provide an improved photoreceptor that exhibits resistance to light shock.

These and other objects of the present invention are achieved by providing an electrophotographic imaging member comprising a charge generating layer including photogenerating particles of hydroxygallium phthalocyanine, alkoxygallium phthalocyanine or mixtures thereof dispersed in a polymer binder, and a charge transport layer comprising a charge transport material, a polymer binder and an additive selected from among triethanolamine (TEA), morpholine, imidazoline or mixtures thereof.

These and other objects are also achieved by providing a method of obtaining a light shock resistant imaging member containing a charge generating layer including photogenerating particles of hydroxygallium phthalocyanine, alkoxygallium phthalocyanine or mixtures thereof dispersed in a polymer binder, the method comprising forming a charge transport layer comprising a charge transport material, a polymer binder and an additive selected from among triethanolamine (TEA), morpholine, an imidazoline or mixtures thereof in association with the charge generating layer.

DETAILED DESCRIPTION OF PREFERRED EMBODIMENTS

Figure 1:
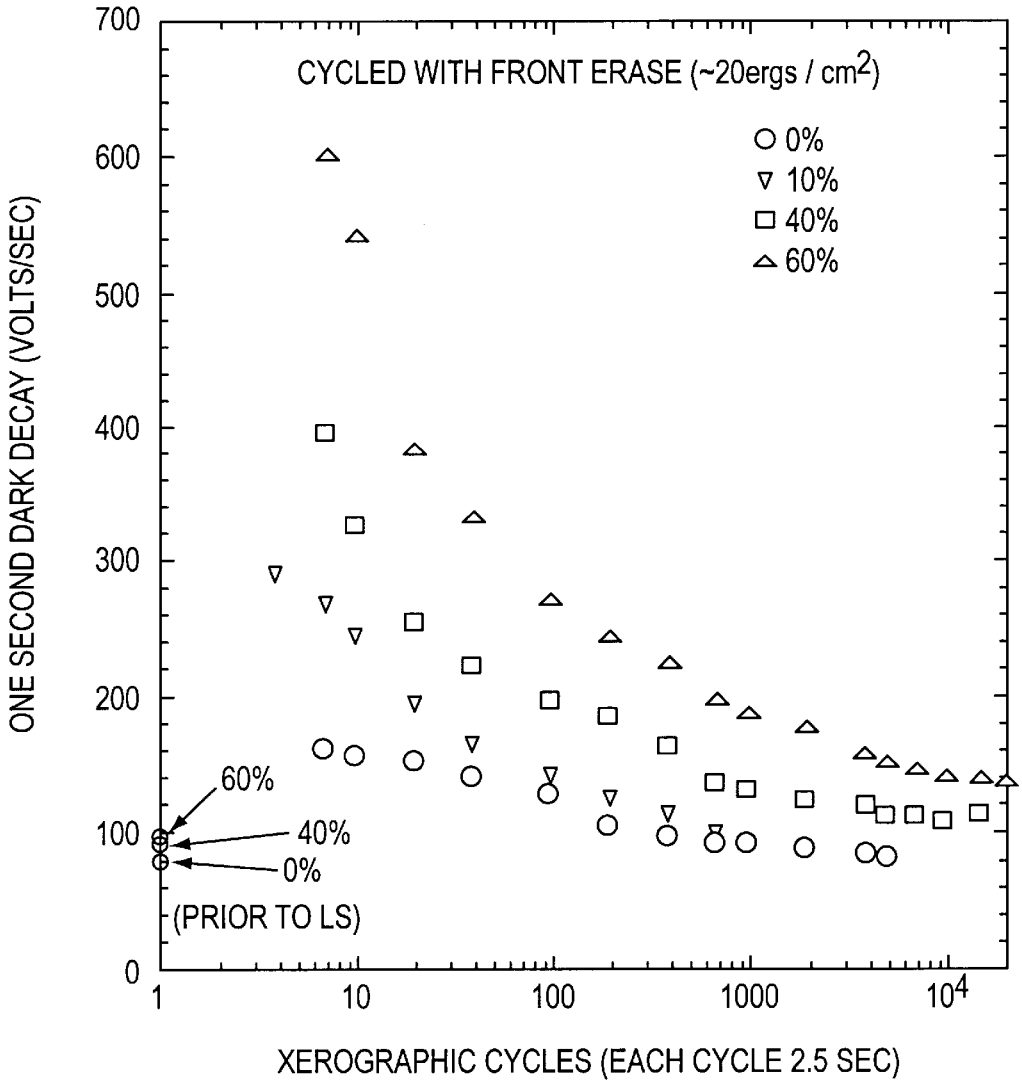
FIGS. 1 and 2 are graphs illustrating the differences in dark decay for a photoreceptor at different numbers of xerographic cycles and varying humidities.
Figure 2:
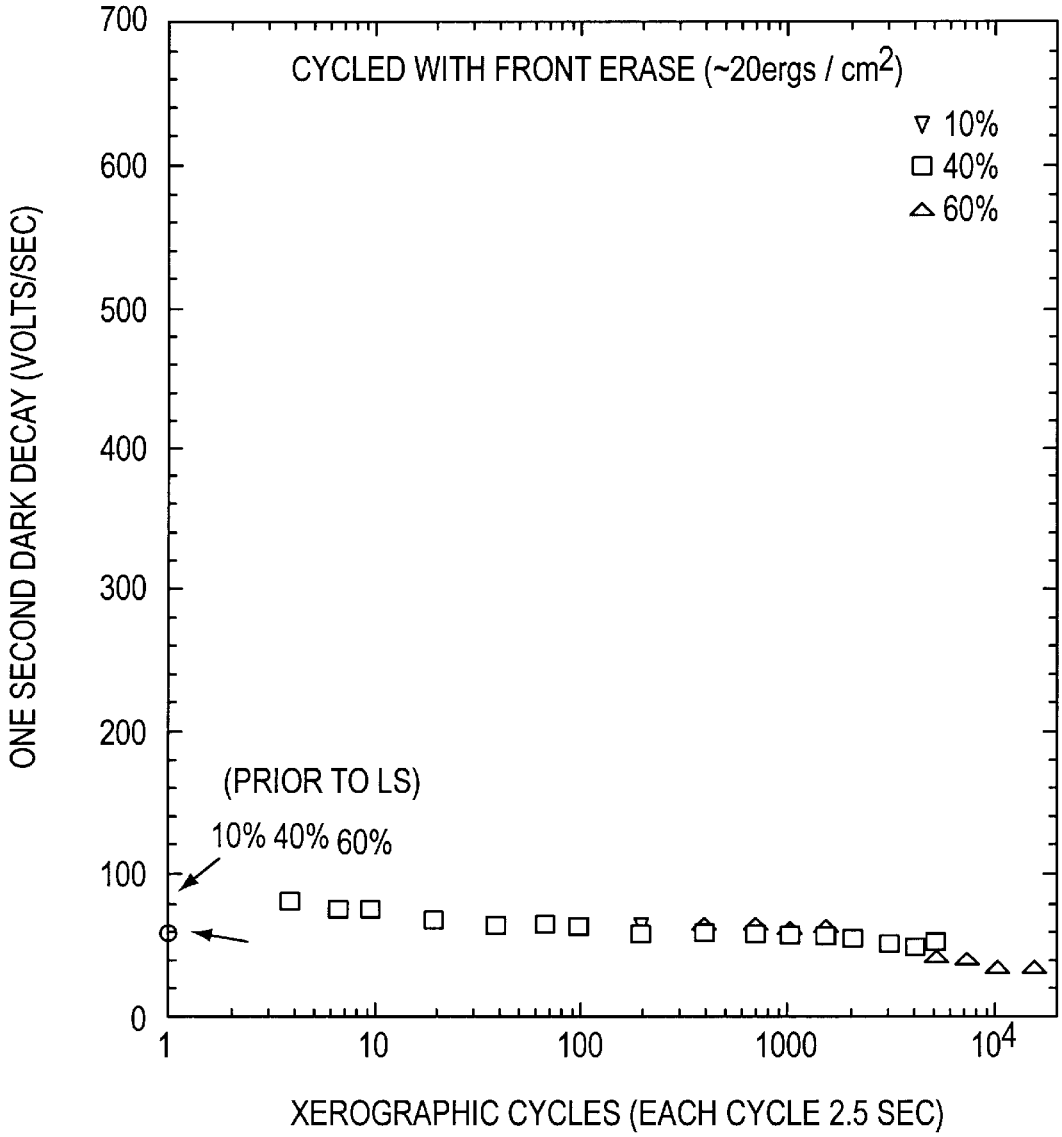

The imaging member of the invention is electrophotographically cycled through uniform charging, imagewise exposure, development, and transfer steps to form toner images on a receiving member.

The imaging members exhibit light shock resistance as a result of the charge transport layer of the photoreceptor containing one of the specified light shock resisting additives of the invention. As used herein, acceptable light shock resistance means that the photoreceptor is within an allowable $V_{ddp}$ as follows:

TABLE 1

| Exposure Time | Dark Rest | Allowed $V_{ddp}$ non-uniformity |
|---|---|---|
| 1 min. | 0 min. | 10 V |
| 3 min. | 5 min. | 10 V |

Thus, "light shock resistant" as used herein means that the photoreceptor has a $V_{ddp}$ non-uniformity of less than 10 V under the specified conditions.

To measure the effect of light shock, each photoreceptor device is mounted on a cylindrical aluminum drum substrate which is rotated on a shaft of a scanner. Each photoreceptor is charged by a corotron mounted along the periphery of the drum. The surface potential is measured as a function of time by capacitively coupled voltage probes placed at different locations around the shaft. The probes are calibrated by applying known potentials to the drum substrate. The photoreceptors on the drums are exposed by a light source located at a position near the drum downstream from the corotron. As the drum is rotated, the initial (pre-exposure) charging potential is measured by a first voltage probe. Further rotation leads to the exposure station, where the photoreceptor is exposed to monochromatic radiation of known intensity.

The photoreceptor is erased by a light source located at a position upstream of charging.

The measurements to be made include charging of the photoreceptor in a constant current or voltage mode. The photoreceptor is charged to a negative polarity corona. As the drum is rotated, the initial charging potential is measured by the first voltage probe. Further rotation leads to the exposure station, where the photoreceptor is exposed to monochromatic radiation of known intensity. The surface potential after exposure is measured by a second and third voltage probe. The photoreceptor is finally exposed to an erase lamp of appropriate intensity and any residual potential is measured by a fourth voltage probe. The process is repeated with the magnitude of the exposure automatically changed during the next cycle. The photodischarge characteristics are obtained by plotting the potentials at the second and third voltage probes as a function of light exposure. The charge acceptance and dark decay are also measured in the scanner. The charge acceptance is measured by operating the corotron in a constant current mode. $V_{ddp}$, the dark development potential, is the potential remaining on the device at a specified time after the charging step.

Electrophotographic imaging members, i.e., photoreceptors, are well known in the art. Typically, a substrate is provided having an electrically conductive surface. At least one photoconductive layer is then applied to the electrically conductive surface. A charge blocking layer may be applied to the electrically conductive surface prior to the application of the photoconductive layer. If desired, an adhesive layer may be utilized between the charge blocking layer and the photoconductive layer. For multilayered photoreceptors, a charge generation binder layer is usually applied onto the blocking layer or optional adhesive layer and a charge transport layer is formed on the charge generation layer. However, if desired, the charge generation layer may be applied to the charge transport layer.

The photoconductor substrate may comprise any suitable organic or inorganic material known in the art. The substrate can be formulated entirely of an electrically conductive material, or it can be an insulating material having an electrically conductive surface.

The substrate may be opaque or substantially transparent and may comprise numerous suitable materials having the required mechanical properties. Accordingly, the substrate may comprise a layer of an electrically non-conductive or conductive material as an inorganic or an organic composition. The entire substrate can comprise the same material as that in the electrically conductive surface or the electrically conductive surface can be merely a coating on the substrate.

Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. As electrically non-conducting materials that may be employed are various resins known for this purpose including polyesters, polycarbonates, polyamides, polyurethanes, paper, glass, plastic, polyesters such as Mylar (available from Du Pont) or Melinex 447 (available from ICI Americas, Inc.), and the like which are rigid or flexible, such as webs.

The thickness of the substrate layer depends on numerous factors, including mechanical and economical considerations, and thus this layer for a flexible belt may be of substantial thickness, for example, about 125 micrometers, or of minimum thickness less than 50 micrometers, provided there are no adverse effects on the final electrostatographic device. The substrate can be either rigid or flexible. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g., 19 millimeter diameter rollers. Substrates in the shape of a drum or cylinder may comprise a metal, plastic or combinations of metal and plastic of any suitable thickness depending upon the degree of rigidity desired.

The conductive layer may vary in thickness over substantially wide ranges depending upon the optical transparency and degree of flexibility desired for the electrostatographic member. Accordingly, for a flexible photoresponsive imaging device, the thickness of the conductive layer may be between about 20 Angstroms to about 750 Angstroms, and more preferably from about 100 Angstroms to about 200 Angstroms for a preferred combination of electrical conductivity, flexibility and light transmission. The flexible conductive layer may be an electrically conductive metal layer formed, for example, on the substrate by any suitable coating technique, such as a vacuum depositing technique. Where the substrate is metallic, such as a metal drum, the outer surface thereof is normally inherently electrically conductive and a separate electrically conductive layer need not be applied.

After formation of an electrically conductive surface, a hole blocking layer may optionally be applied thereto. Generally, hole blocking layers (also referred to as electron blocking layers or charge blocking layers) for positively charged photoreceptors allow holes from the imaging aging surface of the photoreceptor to migrate toward the conductive layer. Any suitable blocking layer capable of forming an electronic barrier to holes between the adjacent photoconductive layer and the underlying conductive layer may be utilized. Blocking layers are well known and disclosed, for example, in U.S. Pat. Nos. 4,286,033, 4,291,110 and 4,338,387, the entire disclosures of each being incorporated herein by reference. Typical hole blocking layers utilized for the negatively charged photoconductors may include, for example, polyamides such as Luckamide (a nylon type material derived from methoxymethyl-substituted polyamide), hydroxy alkyl methacrylates, nylons, gelatin, hydroxyl alkyl cellulose, organopolyphosphazines, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

The blocking layer may be applied as a coating by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like.

The blocking layer may comprise an oxidized surface which inherently forms on the outer surface of most metal ground plane surfaces when exposed to air. The blocking layer should be continuous and have a thickness of less than about 2 micrometers because greater thicknesses may lead to undesirably high residual voltage.

An optional adhesive layer may applied to the hole blocking layer. Any suitable adhesive layer well known in the art may be utilized. Satisfactory results may be achieved with an adhesive layer thickness between about 0.05 micrometer (500 Angstroms) and about 0.3 micrometer (3,000 Angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

The charge generating, or photogenerating, layer of the photoreceptor comprises photogenerating particles selected from the group consisting of hydroxygallium phthalocyanine particles, alkoxygallium phthalocyanine and mixtures thereof dispersed in a polymer binder. Alkoxygallium phthalocyanine has the chemical name (Gallium,.mu.-1,2-ethanediolato(2-)-O:O'bis29H,31H-phthalocyaninato(2-)-N29,N30,N31,N32di-, CAS Registry No. 164637-99-4), the chemical formula $C_{66}H_{36}Ga_3N_{16}O_2$ as illustrated in the structure:

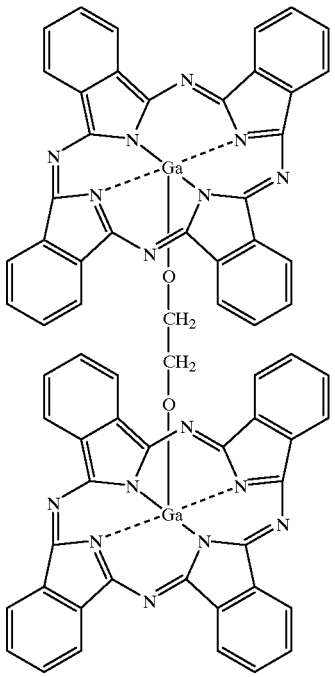

Photoreceptors employing hydroxygallium phthalocyanine and alkoxygallium phthalocyanine particles as photogenerating pigments are particularly susceptible to light shock and the problems associated therewith, particularly compared to photoreceptors containing trigonal selenium or benzimidazole perylene (BzP) which do not experience light shock problems.

Photoconductive hydroxygallium phthalocyanine particles and alkoxygallium phthalocyanine particles are well known in the art. These particles are available in numerous polymorphic forms. Any suitable hydroxygallium phthalocyanine or alkoxygallium phthalocyanine polymorph may be used in the charge generating layer of the photoreceptor this invention. Hydroxygallium phthalocyanine and alkoxygallium phthalocyanine polymorphs are extensively described in the technical and patent literature. For example, hydioxygallium phthalocyanine Type V and other polymorphs are described in U.S. Pat. No. 5,521,306, the entire disclosure of which being incorporated herein by reference.

The photogenerating pigments are dispersed in a polymer binder to form the charge generating layer. The polymer binder may comprise any known polymer binders known in the art.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Most preferably, the charge generating layer comprises a binder comprising a copolymer of polystyrene and polyvinyl pyridine, poly(4,4'-diphenyl-1,1'-cyclohexane carbonate), or mixtures thereof. Preferably, the copolymer of polystyrene and polyvinyl pyridine is polystyrene co-4-vinylpyridine, a block copolymer with compositional ratios of the 4-vinylpyridine to styrene in the range of from about 5/95 to about 30/70, and more preferably in the range of from about 8/92 to about 20/80. These copolymers have weight average molecular weights in the range of from about 5,000 to about 100,000 with the preferred range being from about 8,000 to about 35,000. See also U.S. Pat. No. 5,384,223, incorporated herein by reference. Poly(4,4'-diphenyl-1,1'-cyclohexane carbonate) is a commercially available resin and obtainable, for example, from Mitsubishi Chemical Co. under the trade name IUPILON Z-200.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The particle size of the photoconductive compositions and/or pigments preferably is less than the thickness of the deposited solidified layer, and more preferably is between about 0.01 micron and about 0.5 micron to facilitate better coating uniformity.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any suitable solvent may be utilized to dissolve the film forming binder. Typical solvents include, for example, tetrahydrofuran, toluene, methylene chloride, monochlorobenzene and the like. Coating dispersions for charge generating layer may be formed by any suitable technique using, for example, attritors, ball mills, Dynomills, paint shakers, homogenizers, microfluidizers, and the like.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the direction of photogenerated holes from the generation material and capable of allowing the transport of these holes through the active layer in order to discharge the surface charge on the active layer.

An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming binder resin in which the aromatic amine is soluble.

The charge transport layer forming mixture preferably comprises an aromatic amine compound of one or more compounds having the general formula:

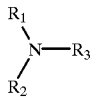

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups and the like.

Examples of charge transporting aromatic amines represented by the structural formulae above for charge transport layers capable of supporting the injection of photogenerated holes of a charge generating layer and transporting the holes through the large transport layer include, for example, triphenylmethane, bis(4-diethylamine-2-methylphenyl) phenylmethane, 4'-4"-bis(diethylamino)-2',2"-dimethyltriphenylmethane, N,N'-bi-s(alkylphenyl)-{1,1'-biphenyl}-4,4'-diamine wherein the alkyl is, for example, methyl, ethyl, propyl, n-butyl, etc., N,N'-diphenyl-N,N'-bis (chlorophenyl)-{1,1'-biphenyl}-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent such as, for example, tetrahydrofuran, toluene, monochlorobenzene and the like may be employed in the process of this invention. Typical inactive resin binders soluble in methylene chloride include polycarbonate resin, polyvinylcarbazole, polyester, polyarylate, polyacrylate, polyether, polysulfone, and the like. Weight average molecular weights can vary from about 20,000 to about 150,000.

The charge transport layer must also include a light shock resisting or reducing additive selected from the group consisting of triethanolamine (2,2',2"-nitrilotrisethanol), morpholine (tetrahydro-2H-1,4-oxazine), an imidazole (1,3-diaza-2,4-cyclopentadiene) and mixtures thereof.

Satisfactory light shock resistance is achieved when the charge transport layer includes between about 0.01 percent and about 25 percent by weight of the additive, more preferably between about 0.1 percent and about 10 percent by weight of the additive, based on the total weight of the charge transport layer, after drying. TEA is preferably added in amounts of from, for example, 0.01% to 0.4%, more preferably of from 0.01% to 0.1% based on the weight of solids in the transport layer. Morphaline is preferably added in amounts of 0.01 to 0.4%, more preferably from 0.01 to 0.2% by weight of solids in the transport layer. Tmidazole is preferably added in amounts of 0.01 to 1.0%, more preferably 0.01 to 0.6% by weight based on the weight of solids in the dried transport layer. Note that the levels of additive reported in the examples appended hereto are based on the solution solvent, and not the solids content.

The additive should be soluble in the solution of solvent and filming binder employed to form the charge transport layer. Any suitable and conventional technique may be utilized to mix and thereafter apply the charge transport layer coating mixture to the coated or uncoated substrate. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

The preferred electrically inactive resin materials are polycarbonate resins having a weight average molecular weight from about 20,000 to about 150,000, more preferably from about 50,000 about 120,000. The materials most preferred as the electrically inactive resin material is poly(4,4'-dipropylidene-diphenylene carbonate) with a weight average molecular weight of from about 35,000 to about 40,000, available as Lexan 145 from General Electric Company; poly(4,4'-propylidene-diphenylene carbonate) with a weight average molecular weight of from about 40,000 to about 45,000, available as Lexan 141 from the General Electric Company; a polycarbonate resin having a weight average molecular weight of from about 50,000 to about 120,000, available as Makrolon from Farbenfabricken Bayer A.G.; and a polycarbonate resin having a weight average molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between conductive surface and a charge transport layer as described above or a charge transport layer sandwiched between a conductive surface and a charge generator layer. Optionally, an overcoat layer may also be utilized to improve resistance to abrasion. In some cases, an anti-curl back coating may be applied to the side opposite the photoreceptor to provide flatness and/or abrasion resistance where a web configuration photoreceptor is fabricated. These overcoating and anti-curl back coating layers are well known in the art and may comprise thermoplastic organic polymers or inorganic polymers that are electrically insulating or slightly semi-conductive. Overcoatings are continuous and commercially have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284, the entire disclosure of which being incorporated herein by reference. A thickness between about 70 and about 160 micrometers is a satisfactory range for flexible photoreceptors.

In addition to the foregoing, light shock has been found to be sensitive to environmental conditions (e.g., humidity) and shelf age. It has been surprisingly found that the light shock resistant additives described herein also act to control light shock as a result of these additional factors.

The invention will now be further described by way of the following examples. All proportions are by weight unless otherwise indicated.

EXAMPLE 1

Several photoreceptors are prepared by forming coatings using conventional techniques on a substrate comprising vacuum deposited titanium layer on a polyethylene terephthalate film. The first coating is a siloxane barrier layer formed from hydrolyzed gamma-aminopropyltriethoxysilane having a thickness of 0.05 micrometer (500 Angstroms). The barrier layer coating composition is prepared by mixing 3-aminopropyltriethoxysilane (available from PCR Research Center Chemicals of Florida) with ethanol in a 1:50 volume ratio. The coating composition is applied by a multiple clearance film applicator to form a coating having a wet thickness of 0.5 mil. The coating is then allowed to dry for 5 minutes at room temperature, followed by curing for 10 minutes at 110 degrees Centigrade in a forced air oven.

The second coating is an adhesive layer of polyester resin (49,000, available from E.I. duPont de Nemours & Co.) having a thickness of 0.05 micron (500 Angstroms). The second coating composition is applied using a 0.5 mil bar and the resulting coating is cured in a forced air oven for 1 minute at 125 degrees Centigrade.

This adhesive interface layer is thereafter coated with a photogenerating layer containing 40 percent by volume hydroxygallium phthalocyanine and 60 percent by volume of a block copolymer of styrene (82 percent)/4-vinyl pyridine (18 percent) having a Mw of 11,000. This photogenerating coating composition is prepared by dissolving 1.5 grams of the block copolymer of styrene/4-vinyl pyridine in 42 mL of toluene. To this solution is added 1.33 grams of hydroxygallium phthalocyanine and 300 grams of ⅛ inch diameter stainless steel shot. This mixture is then placed on a ball mill for 20 hours. The resulting slurry is thereafter applied to the adhesive interface with a Bird applicator to form a layer having a wet thickness of 0.25 mil. This layer is dried at 135° C. for 5 minutes in a forced air oven to form a photogenerating layer having a dry thickness 0.4 micrometer.

EXAMPLE 2

On one of the devices fabricated in Example 1, the next applied layer is a transport layer which is formed by using a Bird coating applicator to apply a solution containing one gram of N,N'-diphenyl-N,N'-bis(3-methyl-phenyl)-(1,1'-biphenyl)-4,4'-diamine (TPD) and one gram of polycarbonate resin poly(4,4'-isopropylidene-diphenylene carbonate) (available as Makrolon® from Farbenfabricken Bayer A.G.) dissolved in 11.5 grams of methylene chloride solvent. The N,N'-diphenyl-N,N'-bis(3-methyl-phenyl)-(1,1'-biphenyl)-4,4'-diamine (TPD) is an electrically active aromatic diamine charge transport small molecule whereas the polycarbonate resin is an electrically inactive film forming binder. The device is dried at 125° C. for 1 minute in a forced air oven to form a dry 25 micrometer thick charge transport layer.

EXAMPLE 3

On one of the devices fabricated in Example 1, the next applied layer is a transport layer containing 50 ppm of triethanolamine (TEA), based on solution solvent, which is formed by using a Bird coating applicator to apply a solution containing one gram of N,N'-diphenyl-N,N'-bis(3-methyl-phenyl)-(1,1'-biphenyl)-4,4'-diamine (TPD) and one gram of polycarbonate resin poly(4,4'-isopropylidene-diphenylene carbonate) (available as Makrolon® from Farbenfabricken Bayer A.G.) and 0.575 milligrams of TEA dissolved in 11.5 grams of methylene chloride solvent. The device is dried at 125° C. for 1 minute in a forced air oven to form a dry 25 micrometer thick charge transport layer.

EXAMPLE 4

On one of the devices fabricated in Example 1, the next applied layer is a transport layer containing 100 ppm of triethanolamine (TEA), based on solution solvent, which is formed by using a Bird coating applicator to apply a solution containing one gram of N,N'-diphenyl-N,N'-bis(3-methyl-phenyl)-(1,1'-biphenyl)-4,4'-diamine (TPD) and one gram of polycarbonate resin poly(4,4'-isopropylidene-diphenylene carbonate) (available as Makrolon® from Farbenfabricken Bayer A.G.) and 1.15 milligrams of TEA dissolved in 11.5 grams of methylene chloride solvent. The device is dried at 125° C. for 1 minute in a forced air oven to form a dry 25 micrometer thick charge transport layer.

EXAMPLE 5

Light Shock Meaurement: The light shock of each of the photoreceptors of Examples 2, 3 and 4 are measured in a scanner before and after subjecting them to a eight minute light expsure to a xenon light source for a total exposure of $1.3\times10^6$ ergs/cm$^2$. To measure the effect of light shock, each photoreceptor device is mounted on a cylindrical aluminum drum substrate which is rotated on a shaft of a scanner. Each photoreceptor is charged by a corotron mounted along the periphery of the drum. The surface potential is measured as a finction of time by capacitively coupled voltage probes placed at different locations around the shaft. The probes are calibrated by applying known potentials to the drum substrate. The photoreceptors on the drums are exposed by a light source located at a position near the drum downstream from the corotron. As the drum is rotated, the initial (pre-exposure) charging potential is measured by voltage probe 1. Further rotation leads to the exposure station, where the photoreceptor is exposed to monochromatic radiation of known intensity. The photoreceptor is erased by a light source located at a position upstream of charging. The measurements made included charging of the photoreceptor in a constant current or voltage mode. The photoreceptor is charged to a negative polarity corona. As the drum is rotated, the initial charging potential is measured by voltage probe 1. Further rotation leads to the exposure station, where the photoreceptor is exposed to monochromatic radiation of known intensity. The surface potential after exposure is measured by voltage probes 2 and 3. The photoreceptor is finally exposed to an erase lamp of appropriate intensity and any residual potential is measured by voltage probe 4. The process is repeated with the magnitude of the exposure automatically changed during the next cycle. The photodischarge characteristics is obtained by plotting the potentials at voltage probes 2 and 3 as a finction of light exposure. The charge acceptance and dark decay are also measured in the scanner. The charge acceptance is measured by operating the corotron in a constant current mode. $V_{ddp}$, the dark development potential, is the potential remaining on the device at a specified time after the charging step. $V_{ddp}$ of the devices in Examples 2, 3 and 4 are measured before and after subjecting them to an eight minute light exposure to a xenon light source for a total exposure of $1.3\times10^6$ ergs/cm$^2$. The reduction in $V_{ddp}$ as a result of this light shock are summarized in Table 2.

TABLE 2

| Light Shock Resisting Additive | $V_{ddP}$ Change |
|---|---|
| None (control; device of Example 2) | 194 V |
| TEA, 50 ppm (device of Example 3) | 54 V |
| TEA, 100 ppm (device of example 4) | 36 V |

From the results in Table 2, it can be seen that the addition of the light shock resisting additive significantly improves the $V_{ddp}$ change, i.e., imparts light shock resistance to the photoreceptor.

EXAMPLE 6

The control device of Example 2 and device from Example 3 are next evaluated for light shock response for a shorter duration of light shock. In this example, the photoreceptors are exposed to ambient room light for 1 minute and then immediately (i.e., no period of dark rest) measured in the scanner to determine $V_{ddp}$ loss. The results are summarized in Table 3.

TABLE 3

| Device | $V_{ddp}$ Change |
|---|---|
| Control Device of Example 2 | 8 V |
| Device of Example 3 with 50 ppm TEA | 3.5 V |

EXAMPLE 7

The control device of Example 2 and device from Example 3 are next evaluated for light shock response for an intermediate duration exposure. In this example, the photoreceptors are exposed to ambient room light for 3 minutes and then measured in the scanner following a rest period of 5 minutes after light shock exposure termination to determine $V_{ddp}$ loss. The results are summarized in Table 4.

TABLE 4

| Device | $V_{ddP}$ Change |
|---|---|
| Control Device of Example 2 | 18 V |
| Device of Example 3 with 50 ppm TEA | 8 V |

The results demonstrate that the control device of Example 2 does not possess light shock resistance, but the device of Example 3 containing 50 ppm TEA of the invention does ($V_{ddp}$<10 V) as a result of the presence of the light shock resisting additive in the charge transport layer.

EXAMPLE 8

Devices similar to those in Examples 2, 3 and 4 are fabricated except that morpholine is substituted for triethanolamine (TEA). Substantial light shock improvements are observed.

EXAMPLE 9

Devices similar to those in Examples 2, 3 and 4 are fabricated except that imadazoline is substituted for TEA. Substantial light shock improvements are observed.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a substrate, a charge generating layer comprising photogenerating particles selected from the group consisting of hydroxygallium phthalocyanine, alkoxygallium phthalocyanine and mixtures thereof dispersed in a polymer binder, and a charge transport layer comprising a charge transport material, a film forming binder and an additive selected from the group consisting of triethanolamine, morpholine, an imidazole and mixtures thereof.

2. The electrophotographic imaging member according to claim 1, wherein the polymer binder comprises a polymer selected from the group consisting of a copolymer of polystyrene and polyvinyl pyridine, poly(4,4'-diphenyl-1,1'-cyclohexane carbonate) and mixtures thereof.

3. The electrophotographic imaging member according to claim 1, wherein the additive is triethanolamine and is present in an amount of from 0.01% to 0.1%, based on overall charge transport layer weight after drying.

4. The electrophotographic imaging member according to claim 1, wherein the additive is morpholine and is present in an amount of from 0.01% to 0.2%, based on overall charge transport layer weight after drying.

5. The electrophotographic imaging member according to claim 1, wherein the additive is an imidazole and is present in an amount of from 0.01% to 0.6%, based on overall charge transport layer weight after drying.

6. The electrophotographic imaging member according to claim 2, wherein the charge generating layer comprises from about 20 percent to about 60 percent by weight of hydroxygallium phthalocyanine particles and from about 80 percent to about 40 percent by weight of the copolymer of polystyrene and polyvinyl pyridine film forming binder, based on the total weight of the charge generating layer after drying.

7. The electrophotographic imaging member according to claim 1, wherein the charge transport material comprises aromatic amine molecules.

8. An electrophotographic imaging device containing the electrophotographic imaging member of claim 1.

9. The electrophotographic imaging device of claim 8, wherein the imaging device is a copier, printer or duplicator.

10. A method of obtaining an imaging member including a charge generating layer comprising photogenerating particles selected from the group consisting of hydroxygallium phthalocyanine, alkoxygallium phthalocyanine and mixtures thereof dispersed in a polymer binder that is resistant to light shock, the method comprising forming a charge transport layer in association with the charge generating layer, the charge transport layer comprising a charge transport material, a film forming binder and an additive selected from the group consisting of triethanolamine, morpholine, an imidazole and mixtures thereof.

11. The method according to claim 10, wherein the polymer binder comprises a polymer selected from the group consisting of a copolymer of polystyrene and polyvinyl pyridine, poly(4,4'-diphenyl-1,1'-cyclohexane carbonate) and mixtures thereof.

12. The method according to claim 10, wherein the additive is triethanolamine and is present in an amount of from 0.01% to 0.1%, based on overall charge transport layer weight after drying.

13. The method according to claim 10, wherein the additive is morpholine and is present in an amount of from 0.01% to 0.2%, based on overall charge transport layer weight after drying.

14. The method according to claim 10, wherein the additive is imidazole and is present in an amount of from 0.01% to 0.6%, based on overall charge transport layer weight after drying.

15. An electrophotographic imaging member comprising:

a substrate, a charge generating layer comprising photogenerating particles selected from the group consisting of hydroxygallium phthalocyanine, alkoxygallium phthalocyanine and mixtures thereof dispersed in a polymer binder, and a charge transport layer comprising a charge transport material, a film forming binder and an additive selected from the group consisting of morpholine, imidazole and mixtures thereof.

16. The electrophotographic imaging member according to claim 15, wherein the additive is morpholine and is present in an amount of from 0.01% to 0.2%, based on overall charge transport layer weight after drying.

17. The electrophotographic imaging member according to claim 15, wherein the additive is an imidazole and is present in an amount of from 0.01% to 0.6%, based on overall charge transport layer weight after drying.

* * * * *